US006270340B1

(12) United States Patent
Lepp

(10) Patent No.: US 6,270,340 B1
(45) Date of Patent: Aug. 7, 2001

(54) REUSABLE CANDLE WICK

(76) Inventor: Al Lepp, 129 Louth Street, Saint Catharines, Ontario (CA), L2S 2T8

( * ) Notice: Subject to any disclaimer, the term of this patent is extended or adjusted under 35 U.S.C. 154(b) by 0 days.

(21) Appl. No.: 09/522,501

(22) Filed: Mar. 10, 2000

(51) Int. Cl.[7] ..... F23D 3/16

(52) U.S. Cl. ..... 431/288; 431/329

(58) Field of Search ..... 431/288, 298, 431/302, 303, 329, 325, 289, 292, 291

(56) References Cited

U.S. PATENT DOCUMENTS 3,652,197 * 3/1972 Tokarz ..... 431/288
4,790,747 * 12/1988 O'Brien ..... 431/288

FOREIGN PATENT DOCUMENTS

2539760 A1 * 3/1977 (DE) ..... 431/291
2942165 A1 * 4/1981 (DE) .
3421597 A1 * 12/1985 (DE) .

* cited by examiner

*Primary Examiner*—Sara Clarke

(57) ABSTRACT

A reusable candle wick for reusability and convenience. The reusable candle wick includes a metal mesh member comprising essentially metal wires formed into a mesh and having an upright stem portion which is essentially a cylinder and further having a plurality of feet portions integrally extending radially and perpendicularly from a base of the stem portion with there being approximately at least 50 per inch. The mesh member is adapted to be placed upon a flat wax surface with the wax and the base of the stem portion being ignited with a flame. As the wax melts, the mesh member sinks into the wax and can be extinguished and reused as desired.

7 Claims, 1 Drawing Sheet

REUSABLE CANDLE WICK

BACKGROUND OF THE INVENTION

1. Field of the Invention

The present invention relates to a reusable candle wick and more particularly pertains to a new reusable candle wick for reusability and convenience.

2. Description of the Prior Art

The use of reusable candle wick is known in the prior art. More specifically, reusable candle wick heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,790,747; U.S. Pat. No. 3,652,197; U.S. Pat. No. 3,083,952; U.S. Pat. No. 1,974,037; U.S. Pat. No. 3,627,191; and U.S. Pat. No. Des. 305,801.

While these devices fulfill their respective, particular objectives and requirements, the aforementioned patents do not disclose a new reusable candle wick. The inventive device includes a metal mesh member comprising essentially metal wires formed into a mesh and having an upright stem portion which is essentially a cylinder and further having a plurality of feet portions integrally extending radially and perpendicularly from a base of the stem portion with there being approximately at least 50 per inch. The mesh member is adapted to be placed upon a flat wax surface with the wax and the base of the stem portion being ignited with a flame. As the wax melts, the mesh member sinks into the wax and can be extinguished and reused as desired.

In these respects, the reusable candle wick according to the present invention substantially departs from the conventional concepts and designs of the prior art, and in so doing provides an apparatus primarily developed for the purpose of reusability and convenience.

SUMMARY OF THE INVENTION

In view of the foregoing disadvantages inherent in the known types of reusable candle wick now present in the prior art, the present invention provides a new reusable candle wick construction wherein the same can be utilized for reusability and convenience.

The general purpose of the present invention, which will be described subsequently in greater detail, is to provide a new reusable candle wick which has many of the advantages of the reusable candle wick mentioned heretofore and many novel features that result in a new reusable candle wick which is not anticipated, rendered obvious, suggested, or even implied by any of the prior art reusable candle wick, either alone or in any combination thereof.

To attain this, the present invention generally comprises a metal mesh member comprising essentially metal wires formed into a mesh and having an upright stem portion which is essentially a cylinder and further having a plurality of feet portions integrally extending radially and perpendicularly from a base of the stem portion with there being approximately at least 50 per inch. The mesh member is adapted to be placed upon a flat wax surface with the wax and the base of the stem portion being ignited with a flame. As the wax melts, the mesh member sinks into the wax and can be extinguished and reused as desired.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new reusable candle wick which has many of the advantages of the reusable candle wick mentioned heretofore and many novel features that result in a new reusable candle wick which is not anticipated, rendered obvious, suggested, or even implied by any of the prior art reusable candle wick, either alone or in any combination thereof.

It is another object of the present invention to provide a new reusable candle wick which may be easily and efficiently manufactured and marketed.

It is a further object of the present invention to provide a new reusable candle wick which is of a durable and reliable construction.

An even further object of the present invention is to provide a new reusable candle wick which is susceptible of a low cost of manufacture with regard to both materials and labor, and which accordingly is then susceptible of low prices of sale to the consuming public, thereby making such reusable candle wick economically available to the buying public.

Still yet another object of the present invention is to provide a new reusable candle wick which provides in the apparatuses and methods of the prior art some of the advantages thereof, while simultaneously overcoming some of the disadvantages normally associated therewith.

Still another object of the present invention is to provide a new reusable candle wick for reusability and convenience.

Yet another object of the present invention is to provide a new reusable candle wick which includes a metal mesh member comprising essentially metal wires formed into a mesh and having an upright stem portion which is essentially a cylinder and further having a plurality of feet portions integrally extending radially and perpendicularly from a base of the stem portion with there being approximately at least 50 per inch. The mesh member is adapted to be placed upon a flat wax surface with the wax and the base of the stem portion being ignited with a flame. As the wax melts, the mesh member sinks into the wax and can be extinguished and reused as desired.

Still yet another object of the present invention is to provide a new reusable candle wick that is very effective and practical.

Even still another object of the present invention is to provide a new reusable candle wick that saves the consumer money by allowing the user to reuse the mesh member as many times as desired.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
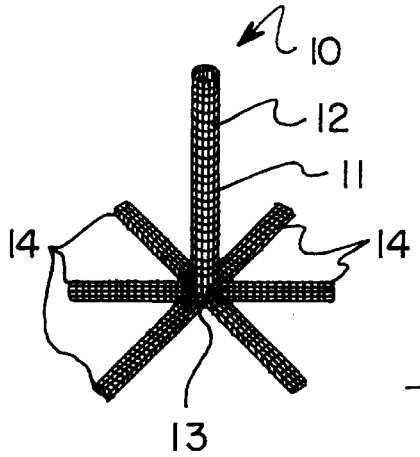
FIG. 1 is a perspective view of a new reusable candle wick according to the present invention.
Figure 2:
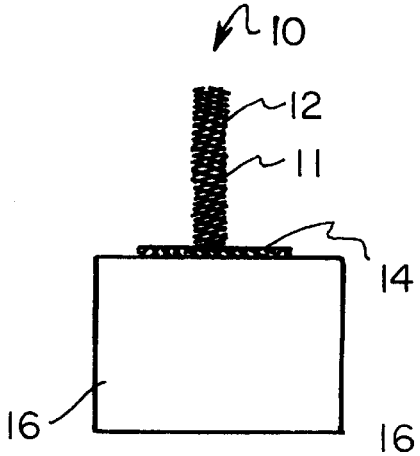
FIG. 2 is a side elevational view of the present invention being used.
Figure 3:
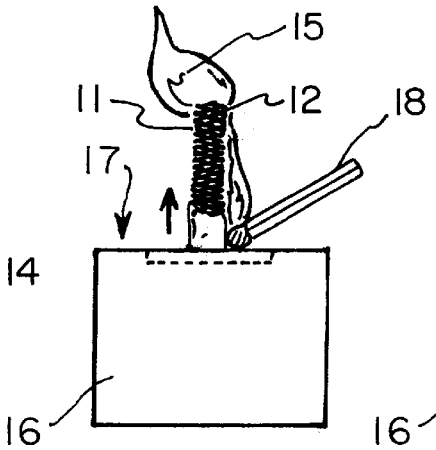
FIG. 3 is a side elevational view of the present invention being used.
Figure 4:
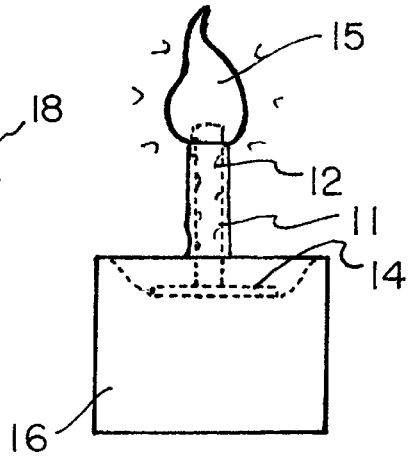
FIG. 4 is a side elevational view of the present invention being used.

With reference now to the drawings, and in particular to FIGS. 1 through 4 thereof, a new reusable candle wick embodying the principles and concepts of the present invention and generally designated by the reference numeral 10 will be described.

As best illustrated in FIGS. 1 through 4, the reusable candle wick 10 generally comprises a mesh member having an upright stem portion and a plurality of feet portions integrally extending outwardly from a base of the upright stem portion. The mesh member is essentially a plurality of metal wires formed into a mesh with the upright stem portion being essentially a cylinder and with the feet portions being spaced apart and extending radially and perpendicularly from the stem portion. The mesh member includes at least fifty of the metal wires per inch with the mesh member including from 4 to 7 feet portions.

In use, the user places the mesh member upon a flat wax surface and then ignites the base of the upright stem portion with a flame from either a lighter or a lighted match such that the mesh member and the wax are heated thus causing molten wax which moves by capillary action up the upright stem portion where the flame is visible at a top end of the stem portion. As the wax melts, the mesh member sinks into the wax. The user can either allow the flame to burn out when the wax no longer exists or can simply extinguish the flame; whereupon, the mesh member can be stored and reused as desired by the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A reusable candle wick comprising:

a mesh member having an upright stem portion and a plurality of feet portions extending outwardly from a base of said upright stem portion; and wherein said mesh member comprises a plurality of metal wires formed into a close mesh such that said mesh member acts as a capillary along a length of each of said plurality of feet.

2. A reusable candle wick as described in claim 1, wherein said upright stem portion is essentially a cylinder.

3. A reusable candle wick as described in claim 2, wherein said feet portions are spaced apart and extend radially and perpendicularly from said stem portion.

4. A reusable candle wick as described in claim 3, wherein said mesh member includes at least fifty of said metal wires per inch.

5. A reusable candle wick as described in claim 4, wherein said mesh member includes from 4 to 7 said feet portions.

6. A method of using a reusable candle wick includes the steps of:

providing a mesh member having an upright stem portion and a plurality of feet portions extending outwardly from a base of said upright stem portion, said mesh member including a plurality of metal wires formed into a mesh with said upright stem portion being essentially a cylinder such that said mesh member comprises a plurality of metal wires formed into a close mesh such that said mesh member acts as a capillary along a length of each of said plurality of feet;

placing said mesh member upon a flat wax surface;

igniting said base of said upright stem portion with a flame such that said mesh member and the wax are heated thus causing molten wax;

allowing said molten wax to move by capillary action up said upright stem portion where a flame is visible at a top end of said stem portion;

allowing said mesh member to sink into the wax; and extinguishing said flame from said upright stem portion.

7. A reusable candle wick comprising:

a mesh member having an upright stem portion and a plurality of feet portions extending outwardly from a base of said upright stem portion, said mesh member being essentially a plurality of metal wires formed into a mesh such that said mesh member comprises a plurality of metal wires formed into a close mesh such that said mesh member acts as a capillary along a length of each of said plurality of feet, said upright stem portion being essentially a cylinder, said feet portions being spaced apart and extend radially and perpendicularly from said stem portion, said mesh member including at least fifty of said metal wires per inch, said mesh member including from 4 to 7 said feet portions.

* * * * *